US005214826A

United States Patent [19]

Fortune

[11] Patent Number: 5,214,826

[45] Date of Patent: Jun. 1, 1993

[54] FASTENER FOR USE WITH SHOES

[76] Inventor: Roy L. Fortune, 13482 Dronfield Ave., Sylmar, Calif. 91342

[21] Appl. No.: 655,482

[22] Filed: Feb. 14, 1991

[51] Int. Cl.[5] ..... A43C 11/22

[52] U.S. Cl. ..... 24/573.1; 24/712; 24/713.1

[58] Field of Search ..... 36/50; 24/713.4, 713.6, 24/573.1, 573.2, 573.5, 713, 713.1, 713.9, 714.6, 715.3, 712

[56] References Cited

U.S. PATENT DOCUMENTS

| | | | |
|---|---|---|---|
| 1,486,138 | 3/1924 | Hanson | 24/573.1 X |
| 1,573,119 | 2/1926 | Pambianco | 24/713.9 |
| 3,137,952 | 6/1964 | Shears | 36/50 |
| 3,197,833 | 8/1965 | Puthuff | 36/50 X |
| 3,217,371 | 11/1965 | Collins | 24/573.1 |
| 4,210,983 | 7/1980 | Green | 24/712 X |
| 4,733,439 | 3/1988 | Gentry | 24/573.1 X |

*Primary Examiner*—James R. Brittain
*Attorney, Agent, or Firm*—Donald Diamond

[57] ABSTRACT

A fastener device for use with shoes of the type having eyelets therein is disclosed which is a simple, inexpensive, aesthetically pleasing substitute for shoe laces. The improved fasteners of the present invention each include a segment of elastic tubing connected between pairs of opposing eyelets through which elastic tubing urges the two flaps of the shoes together in a manner allowing both easy installation of the shoes and comfortable wearing of the shoes without removing the fasteners. The fasteners include mounting apparatus which allows for simple installation into the eyelets through the use of mating fasteners which snap together in removable but sturdy fashion.

32 Claims, 3 Drawing Sheets

FIG. 1
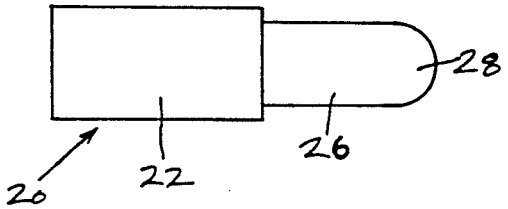
FIG. 2
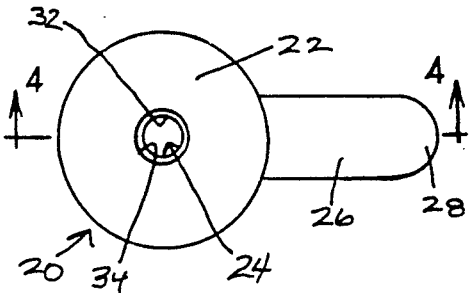
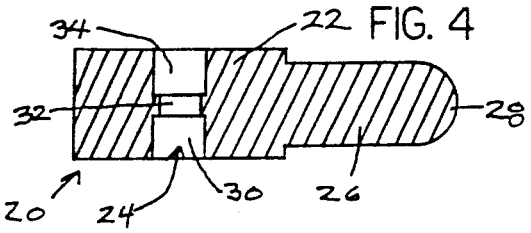
FIG. 4
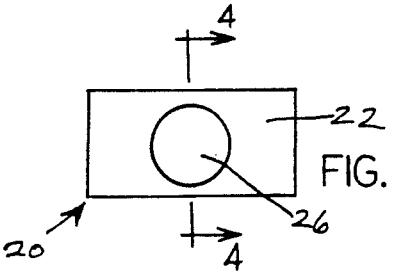
FIG. 3
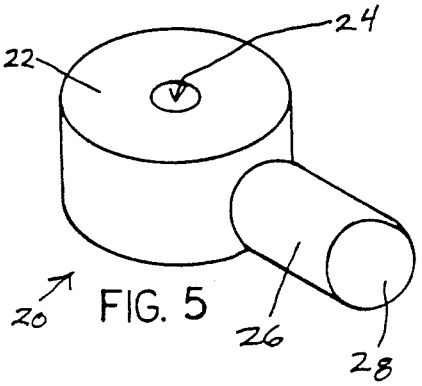
FIG. 5
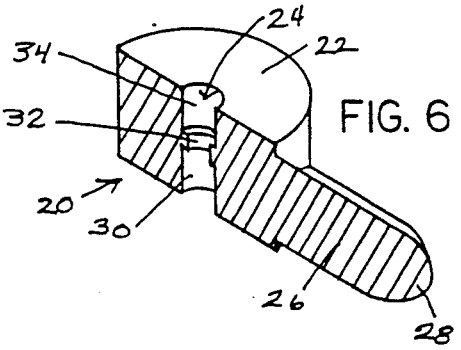
FIG. 6
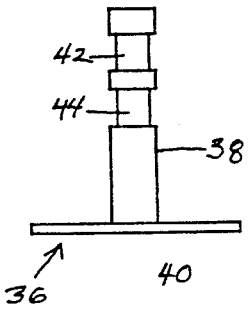
FIG. 7
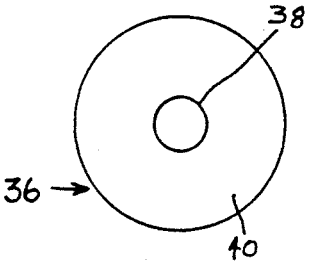
FIG. 8
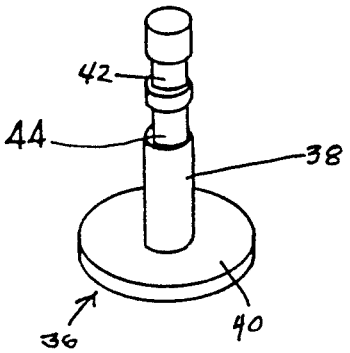
FIG. 9

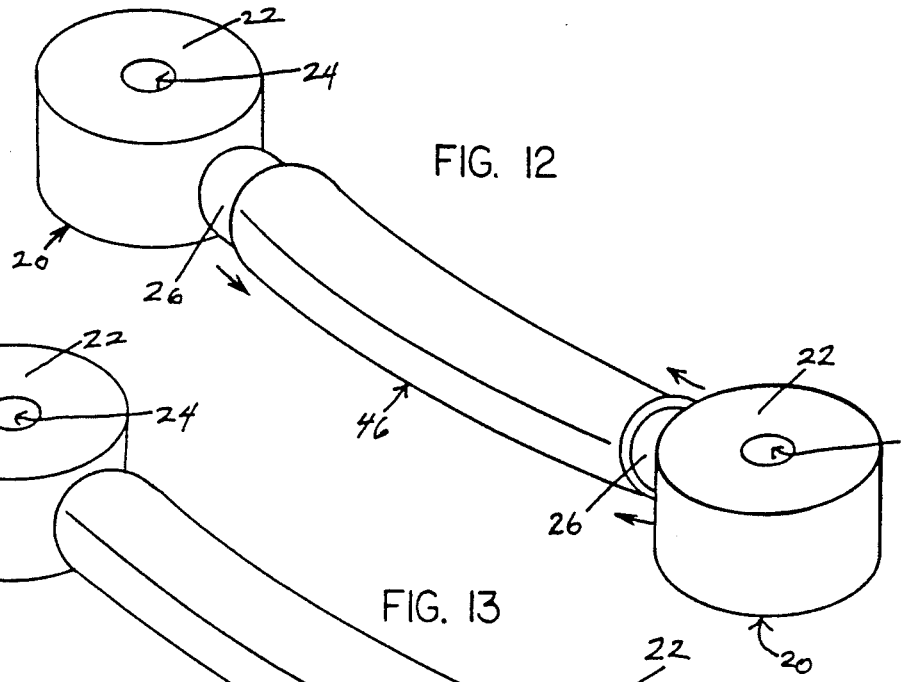
FIG. 12
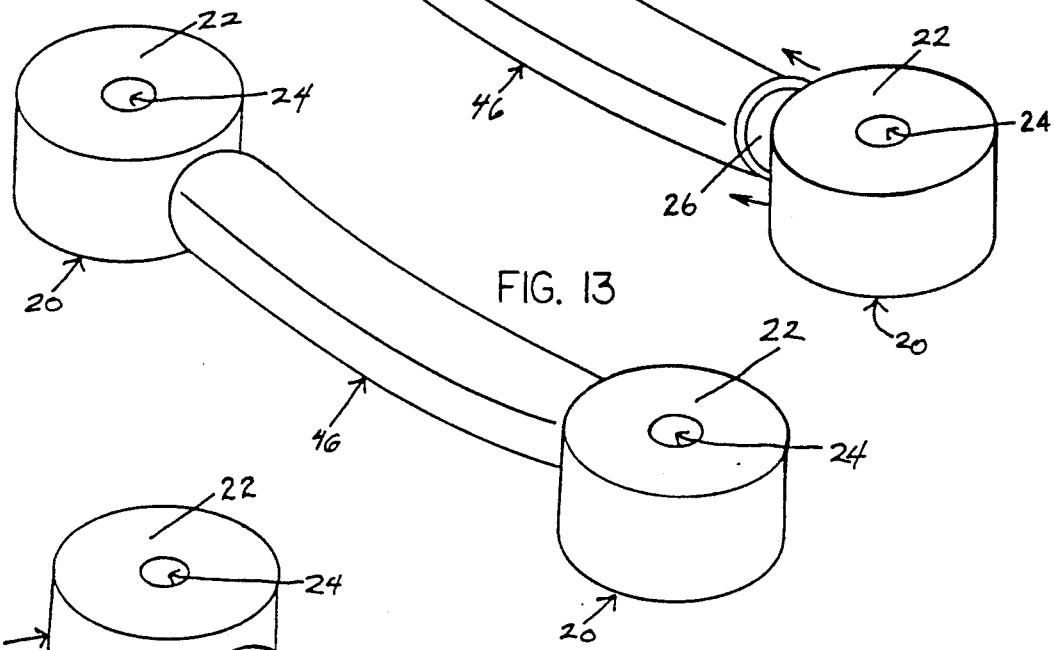
FIG. 13
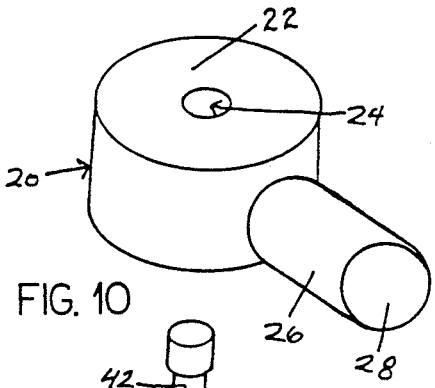
FIG. 10
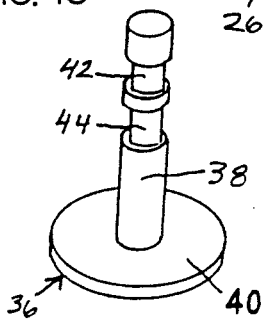
FIG. 11
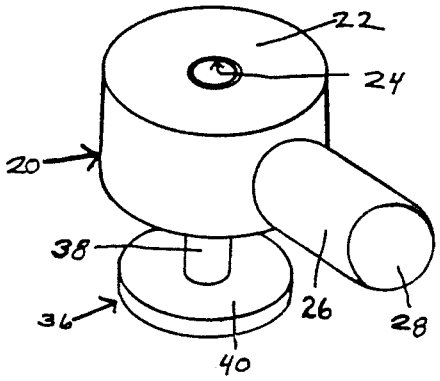

FASTENER FOR USE WITH SHOES

BACKGROUND OF THE INVENTION

Field of the Invention

The present invention relates generally to elastic fasteners for shoes, and more particularly to simple, inexpensive, aesthetically pleasing, easily installed substitutes for shoe laces which each fit between pairs of opposing eyelets in shoes, and which resiliently urge the two flaps of the shoes together in a manner allowing both easy installation of the shoes and comfortable wearing of the shoes without removing the fasteners of the present invention.

As long as shoes have been worn, people have tried to find better ways to fasten them to their feet. At present, the vast majority of shoes utilize laces which are threaded through eyelets located in flaps on the sides of the portion of the shoe in front of the wearer's ankle. The flaps are separated wider apart to allow the wearer's foot to be inserted, and are pulled closer together once the wearer's foot is in the shoe to retain the shoe on the foot. In the past, hardware such as buttons and hooks were used to draw the two flaps together, but these types of fasteners are virtually unused at the present time.

Popular alternatives today include the use of an elastic strip sewn to the two flaps in loafers, the use of zippers in some boots, and the use of Velcro mating strips to fasten the two flaps of shoes together, particularly in athletic shoes for children. Nonetheless, the most popular shoe fasteners today by a wide margin are shoelaces and eyelets. Although eyelets are found in virtually all shoes other than loafers and slippers, various schemes have been and continue to be devised to use different fasteners with shoes having eyelets in the flaps thereof.

For example, U.S. Pat. No. 4,918,840, to Nardulli, teaches a novel fastener having a zipper, the sides of which are fastened to the eyelets in the two flaps of a shoe by elastic loops and buttons. U.S. Pat. No. 4,907,352, to Ginsberg discloses a Velcro fastener having base members which may be attached using the eyelets to the flaps of a conventional pair of shoes. These two schemes have some disadvantages in that they are not simple of construction (and thus not inexpensive), they are not easy to attach to the eyelets of shoes (both requiring some time to attach to the shoes), and their appearance may not be seen by potential users as aesthetically pleasing.

Another approach which has found application in the art is the use of elastic fasteners extending between pairs of eyelets in shoes to draw the two flaps together. Elastomeric members thus may be stretched to allow the shoe to be put on the foot without removing the elastomeric members. Once the shoe is on the foot, the elastomeric members draw the two flaps together, keeping the fit of the shoe on the foot comfortably snug.

Examples of elastomeric fasteners for shoes are abundant in the art, and include such dated devices as those found in U.S. Pat. No. 1,966,135, to Reh, and in U.S. Pat. No. 2,689,991, to Fedankiw et al. The Reh patent shows an early use of elastomeric material, with an elastomeric loop being fastened to each eyelet by a washer or a button. Elastomeric loops on opposing pairs of eyelets are held together by a metal connecting link. The Reh apparatus is simply not practical, since the inventor calls for the elastomeric loop to be removable to facilitate installation; in order for it to be fixed, it would require tools to fasten it, an undesirable factor.

The Fedankiw et al. patent uses an elastomeric segment which is threaded through the eyelets, and then retained by a holding plate which is crimped over the elastomeric segment in several places. Like the Reh apparatus, the Fedankiw et al. shoe fastener is not practical in today's world of self-installation. If the prospective consumer cannot install a shoe fastener quickly and simply, and without tools, the shoe fastener will have no market appeal.

Several foreign patents of this era may also be found; examples of these patents are British Patent No. 213,204, to Hansen; and Italian Patent No. 435,849, to Ottaviani. The Hansen patent discloses an elastic strip fastening onto hooks mounted in shoes, instead of eyelets. The Ottaviani patent teaches a spring attached by rivets to opposing eyelets in the flaps of a shoe. These devices seem to be a step backward from the devices taught in the Reh and Fedankiw et al. patents.

More recent U.S. patents have more practical fasteners, at least from the standpoint that they are relatively easy to install and may be installed by the wearer. See, for example, U.S. Pat. No. 2,839,804, to Benoit; U.S. Pat. No 3,137,952, to Shears; U.S. Pat. No. 3,197,833, to Puthuff; U.S. Pat. No. 3,217,371, to Collins; and U.S. Pat. No. 4,733,439, to Gentry. The Benoit patent teaches elastic laces each stretching between a pair of eyelets on opposing flaps of a shoe. The retaining means is the weak point of the Benoit reference; the Z-shaped ends of the laces are received in an anchor plate member, with staples being used to hold the ends of the laces to the anchor plate member.

The Shears reference has elastic straps extending between pairs of eyelets on opposing flaps of a shoe. Shears, like Benoit, has a weakness in the attachment means, which is through screw members mounted on the opposed sides of the flaps. The Shears fastener is also complex of construction, being in this regard less desirable than Benoit. The Puthuff fastener is even more complex, using special intricate hooks, a tongue pad, and, in the preferred embodiment, a cover for the entire apparatus.

The Collins patent teaches another highly complex elastic fastener which is riveted to the eyelets. Even in the alternate embodiment, a rivet-like connector is required. The many parts of the Collins device also indicate its likely high cost. The Benoit, Shears, Puthuff, and Collins devices are all thus complex to attach, and seem to be designed for installation by a shoemaker. It can hardly be a coincidence that all of these references are from an era in which people used shoemakers much more than they do today.

The Gentry patent is more recent, and is of a more practical nature as well. Gentry uses a number of elastic strips, each of which has fasteners at both ends. The fasteners on each strip are inserted into opposing eyelets in the flaps. Pins, rivets, or hooks are used to retain the ends of the strips in the eyelets. The elastic strips have a design thereon. Gentry represented a remarkable improvement over the other references noted above.

However, the Gentry reference has some drawbacks as well, the most notable of which is its method of attachment to the eyelets. The pins are difficult to install, and may easily work their way out of the loops at the ends of the strips. The rivets are apparently designed to pop into the eyelets, and it seems likely that they would have a propensity to pop out as well. The hooks are more difficult to install, and may come out as well. In addition, the design of the strips in the Gentry patent makes it likely that they would tear and break over time.

Thus, it is apparent that there is room in the art for improvement. It is the primary objective of the improved fastener of the present invention that it provide an improved means of attaching an elastomeric member to eyelets. The attachment means must first be simple and inexpensive of construction. It must also be easy to attach to eyelets, and must require no tools to make the attachment. Once attached, the fastener of the present invention should remain securely attached to the eyelet to which it is fastened. It should also preferably be removable from the shoe onto which it has been installed, in a manner not damaging the fastener and allowing for its reuse.

In addition, the fastener of the present invention must be comfortable in use on shoes. It must allow for the shoes to be put on easily, and it must retain the flaps of the shoes snugly once they are installed. The fastener must also be highly durable, lasting for an extended period of time. It must be aesthetically pleasing as well. In order to enhance the marketability of the fastener of the present invention, it must also be of inexpensive construction. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, a simple fastener is provided for attachment between opposing pairs of eyelets in the flaps of shoes. The fastener utilizes an elastomeric segment extending between two sets of members, each of which sets of members includes two components which engage to attach the device to one of the opposing eyelets.

In the preferred embodiment, a first mating member comprises a cylindrical segment having a longitudinal aperture extending therethrough. The first mating member also includes a cylindrical shaft extending radially outwardly from the side of the cylindrical segment. A second mating member consists essentially of a thin cylindrical mounting post which extends orthogonally from the center of a disc-shaped flange.

The interior of the aperture in the cylindrical segment of the first mating member and the exterior of the thin cylindrical mounting post of the second mating member are contoured to cooperate in a manner tending to retain the thin cylindrical mounting post of the second mating member in the aperture in the cylindrical segment of the first mating member once the thin cylindrical mounting post of the second mating member is inserted into the aperture in the cylindrical segment of the first mating member. By the exertion of sufficient force, the first mating member may be removed from the second mating member without damage, and both members may be reused.

The elastomeric segment consists of a segment of elastomeric tubing having two ends. The cylindrical shaft mounted on the cylindrical segment of one of the first mating members is inserted into one end of the elastomeric tubing, and the cylindrical shaft mounted on the cylindrical segment of another of the first mating members is inserted into the other end of the elastomeric tubing. In the preferred embodiment, the fit of the elastomeric tubing on the cylindrical shafts of the first mating members requires at least some degree of stretching of the elastomeric tubing. In addition, in the preferred embodiment the ends of the elastomeric tubing are glued onto the cylindrical shafts of the first mating members.

To install the assembly thus manufactured, the post of one of the second mating members is inserted from the bottom through an eyelet in one flap of a shoe. The thin mounting post of the one of the second mating members is then inserted into the aperture in the cylindrical segment of one of the first mating members at one end of the elastomeric tubing. The post of the other of the second mating members is inserted from the bottom through the opposing eyelet in the other flap of the shoe. The thin mounting post of the other of the second mating members is then inserted into the aperture in the cylindrical segment of the other of the first mating members at the other end of the elastomeric tubing.

Additional assemblies of two first members having a segment of elastomeric tubing therebetween and two additional second members may be installed for each additional opposing pair of eyelets in the shoe. By making the segments of tubing of an appropriate length, the effect of the fasteners of the present invention will be to allow the shoe to be installed onto the foot of the wearer without removing the fasteners of the present invention. Once the shoe is so installed, the fasteners of the present invention will act to retain the shoe on the foot of the wearer.

By varying the length, thickness, and material of the segments of elastomeric tubing, the overall fit and feel of the fasteners of the present invention may be adjusted. The preferred material of the segments of elastomeric tubing is rubber or the like, which may be manufactured in any desired color. It will be also appreciated by those skilled in the art that the first and second mating members may be molded of plastic in any color desired (neon colors are preferred).

It may therefore be seen that the present invention teaches an improved means of attaching an elastomeric member to eyelets. The attachment means is simple and inexpensive of construction. It is easily attached to eyelets, and requires no tools to make the attachment. Once attached, the fasteners of the present invention remain securely attached to the eyelets to which they are fastened. They are also removable from the shoe onto which they have been installed, in a manner which does not damage the fasteners and which thus allows for their reuse.

In addition, the fasteners of the present invention are quite comfortable in their use on shoes. They allow for the shoes to be put on quite easily, and they retain the flaps of the shoes snugly once they are installed. The fasteners are also highly durable, and will last for an extended period of time. They are aesthetically pleasing as well, and may be made in any of a number of appealing colors. The fasteners of the present invention are also of inexpensive construction, thus further enhancing their marketability. Finally, all of the aforesaid advantages and objectives are achieved without incurring any substantial relative disadvantage.

DESCRIPTION OF THE DRAWINGS

These and other advantages of the present invention are best reference to the drawings, in which:

FIG. 1 is a first side view of a first mating member showing a cylindrical shaft extending radially outwardly from a cylindrical segment;

FIG. 2 is a top view of the first mating member shown in FIG. 1, showing an aperture extending longitudinally through the cylindrical segment;

FIG. 3 is a second side view of the first mating member shown in FIGS. 1 and 2, showing the cylindrical configuration of the cylindrical shaft extending radially outwardly from the cylindrical segment;

FIG. 4 is a first cross-sectional view of the first mating member shown in FIGS. through 3, showing the configuration of the aperture extending longitudinally through the cylindrical segment;

FIG. 5 is a perspective view of the first mating member shown in FIGS. 1 through 4, showing the overall configuration of the first mating member;

FIG. 6 is a cross-sectional perspective view of the first mating member shown in FIGS. 1 through 5, also showing the configuration of the aperture extending longitudinally through the cylindrical segment;

FIG. 7 is a side view of a second mating member showing a thin cylindrical mounting post extending orthogonally from a disc-shaped flange;

FIG. 8 is a top view of the second mating member shown in FIG. 7, showing the configuration of the disc-shaped flange;

FIG. 9 is a perspective view of the second mating member shown in FIGS. 7 and 8, showing the outer configuration of the thin cylindrical mounting post;

FIG. 10 is a perspective view of one of the first mating members shown in FIGS. 1 through 6 being attached to one of the second mating members shown in FIGS. 7 through 9;

FIG. 11 is a perspective view of the first and second mating members shown in FIG. 10 in their mating configuration;

FIG. 12 shows the cylindrical shafts of two of the first mating members shown in FIG. 1 through 6 being inserted into the ends of a segment of elastomeric tubing;

FIG. 13 shows the assembly of FIG. 12 in its finished appearance;

DETAILED DESCRIPTION OF THE PREFERRED EMBODIMENT

Figure 14:
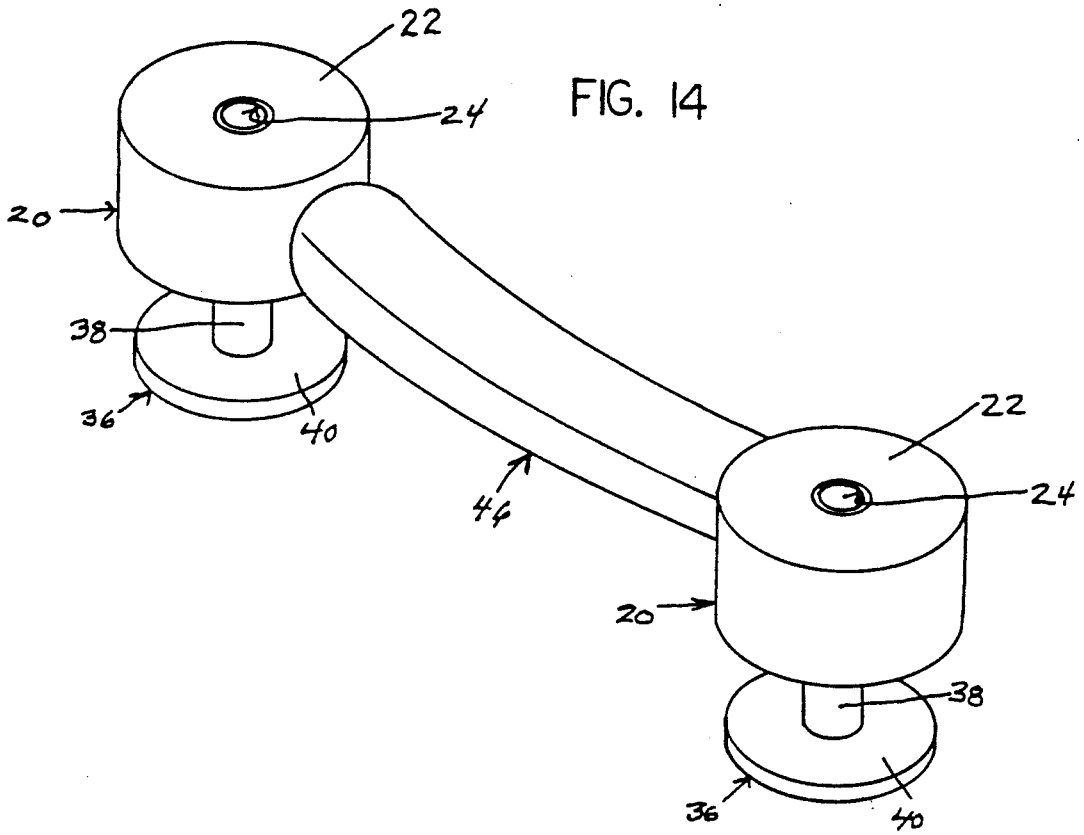
FIG. 14 is a perspective view of the assembly of FIG. 11 attached in mating configuration with two of the second mating members shown in FIGS. 7 through 9.

The preferred embodiment of the present invention provides a fastener which is for attachment between opposing pairs of eyelets in the flaps of shoes. The fastener of the present invention consists of three different components: an elastomeric segment, a first member, one of which first members is attached to each end of the elastomeric segment, and a second member, one of which second members is used with each of the first members to engagingly attach the fastener of the present invention to one of an opposing pair of eyelets.

Referring first to FIGS. through 6, a first mating member 20 is illustrated which comprises a cylindrical segment 22 having a longitudinal aperture shown generally as 24 extending therethrough. A generally cylindrical shaft 26 extends radially outwardly from the side of the cylindrical segment 22. In the preferred embodiment, the end of the cylindrical shaft 26 not connected to the side of the cylindrical segment 22 is rounded as shown by the reference numeral 28.

Referring now specifically to FIGS. 4 and 6, the preferred configuration of the aperture 24 is illustrated. The aperture 24 illustrated includes three cylindrical apertures 30, 32, and 34 which are adjacent and coaxial. The cylindrical aperture 30 is located adjacent the bottom of the cylindrical segment 22, the cylindrical aperture 34 is located adjacent the top of the cylindrical segment 22, and the reduced diameter cylindrical aperture 32 is located intermediate the cylindrical apertures 30 and 34.

The diameters of the cylindrical apertures 30 and 34 in the preferred embodiment are identical, and are larger than the diameter of the reduced diameter cylindrical aperture 32. The reduced diameter of the reduced diameter cylindrical aperture 32 will act to retain the first mating member 20 on a second member, to be discussed in detail immediately below.

A second mating member 36 is illustrated in FIGS. 7 through 9. The second mating member 36 consists essentially of a thin cylindrical mounting post 38 which extends orthogonally from the center of a disc-shaped flange 40. The diameter of the disc-shaped flange 40 in the preferred embodiment may be approximately the same as the diameter of the cylindrical segment 22 of the first mating member 20 (FIG. 2). It should be noted at this point that the diameters of both the disc-shaped flange 40 and the cylindrical segment 22 of the first mating member 20 may vary somewhat without departing from the principles of the present invention. For that matter, the disc-shaped flange 40 and the cylindrical segment 22 of the first mating member 20 could be square instead of circular in configuration.

The thin cylindrical mounting post 38 has a uniform diameter throughout its length except for two reduced diameter segments 42 and 44 along its length. The first reduced diameter segment 42 is located away from the free end of the thin cylindrical mounting post 38. The second reduced diameter segment 44 is spaced away from the first reduced diameter segment 42 in a direction toward the disc-shaped flange 40 from the first reduced diameter segment 42. However, the second reduced diameter segment 44 is also spaced away from the disc-shaped flange 40.

Note that the heights of the first reduced diameter segment 42 and the second reduced diameter segment 44 (their lengths along the length of the thin cylindrical mounting post 38) are equal. The heights of the first reduced diameter segment 42 and the second reduced diameter segment 44 are also higher (longer) than the height (length) of the reduced diameter cylindrical aperture 32 in the cylindrical segment 22 of the first mating member 20.

The outer diameter of the larger diameter portions of the thin cylindrical mounting post 38 (those portions other than the first and second reduced diameter segments 42 and 44) is slightly smaller than the inner diameter of the cylindrical apertures 30 and 34 of the first mating member 20. Likewise, the outer diameter of the first and second reduced diameter segments 42 and 44 of the thin cylindrical mounting post 38 is slightly smaller than the inner diameter of the reduced diameter cylindrical aperture 32 of the first mating member 20. However, the inner diameter of the reduced diameter cylindrical aperture 32 of the first mating member 20 is smaller than the outer diameter of the larger diameter portions of the thin cylindrical mounting post 38.

Thus, the reduced diameter cylindrical aperture 32 of the first mating member 20 provides an interference fit on the larger diameter portions of the thin cylindrical mounting post 38. The reduced diameter cylindrical aperture 32 of the first mating member 20 and the first and second reduced diameter segments 42 and 44 are thus designed to cooperate to retain the reduced diameter cylindrical aperture 32 of the first mating member 20 in either the first reduced diameter segment 42 or the second reduced diameter segment 44 once it is so placed.

Referring to FIG. 10, the first mating member 20 is illustrated above the second mating member 36, with the thin cylindrical mounting post 38 about to enter the bottom of the aperture 24. The interference fit of the reduced diameter cylindrical aperture 32 of the first mating member 20 on the larger diameter portions of the thin cylindrical mounting post 38 must be overcome to insert the free end of the thin cylindrical mounting post 38 through the reduced diameter cylindrical aperture 32 of the first mating member 20. As the reduced diameter cylindrical aperture 32 of the first mating member 20 (FIG. 4) moves past the first larger diameter portion of the thin cylindrical mounting post 38, it will enter the first reduced diameter segment 42 on the thin cylindrical mounting post 38. This position is illustrated in FIG. 11.

Once the reduced diameter cylindrical aperture 32 of the first mating member 20 is placed in the first reduced diameter segment 42 of the thin cylindrical mounting post 38 (or even further on the thin cylindrical mounting post 38 into the second reduced diameter segment 44), this interference fit will tend to retain it in this position. The interference fit of the reduced diameter cylindrical aperture 32 of the first mating member 20 on the larger diameter portions of the thin cylindrical mounting post 38 must be overcome to remove the thin cylindrical mounting post 38 from the first mating member 20.

Thus force must be exerted on the first mating member 20 to install it on the thin cylindrical mounting post 38 of the second mating member 36. Once installed in either of the two positions on the thin cylindrical mounting post 38 of the second mating member 36, the first mating member 20 will stay securely in place. However, by the exertion of sufficient force, the first mating member 20 may be removed from the thin cylindrical mounting post 38 of the second mating member 36 without damage, and both the first and second mating members 20 and 36 may be reused.

Referring next to FIG. 12, an elastomeric segment consisting in the preferred embodiment of a segment of elastomeric tubing 46 is shown being installed between two of the first mating members 20. The segment of elastomeric tubing 46 has a first end and a second end, and is hollow. In the preferred embodiment, the segment of elastomeric tubing 46 is made of silicone rubber or a similar material. Such materials may be obtained in a wide variety of colors, including bright neon colors.

The rounded end 28 of the cylindrical shaft 26 of one of the first mating members 20 is inserted into one end of the elastomeric tubing 46. Similarly, the rounded end 28 of the cylindrical shaft 26 of another of the first mating members 20 is inserted into the other end of the elastomeric tubing 46. The completed assembly looks as shown in FIG. 13.

In the preferred embodiment, the fit of the elastomeric tubing 46 on the cylindrical shafts 26 of the first mating members 20 requires at least some degree of stretching of the elastomeric tubing 46. In addition, in the preferred embodiment the ends of the elastomeric tubing 46 are adhesively secured onto the cylindrical shafts 26 of the first mating members 20.

Figure 15:
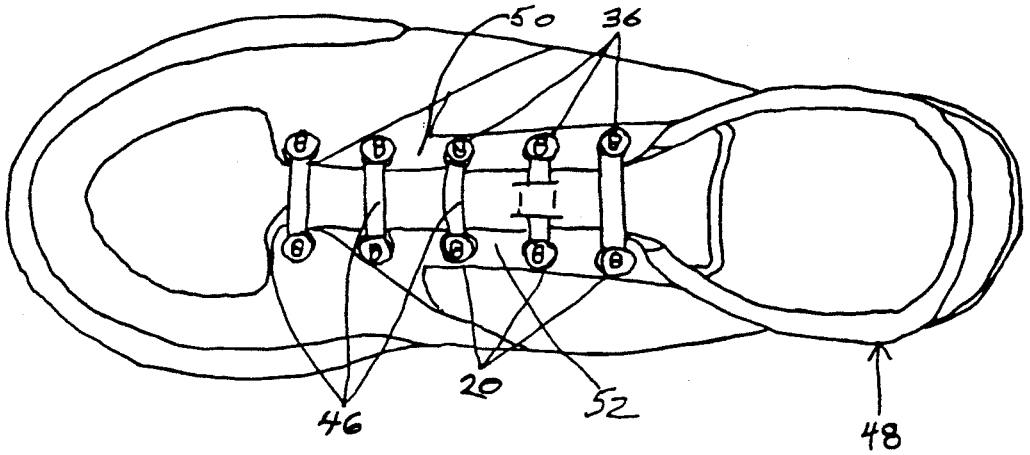
FIG. 15 is a top plan view of an athletic shoe having five sets of the fastening apparatus of the present invention as shown in FIG. 14 installed thereon.

Referring next to FIG. 14, the installation of two of the second mating members 36 into the assembly of FIG. 13 to produce a completed fastener is illustrated. It will be understood that the thin cylindrical mounting posts 38 of the second mating members 36 will not be inserted into the apertures 24 of the first mating member 20 until the fastener is to be installed onto a shoe. The installation of five of the fasteners of the present invention onto a shoe 48 is illustrated in FIG. 15.

To install one of the fasteners of the present invention on a shoe, the thin cylindrical mounting post 38 of one of the second mating members 36 is inserted from the bottom of a first flap 50 through an eyelet in the flap 50 of the shoe 48. The thin cylindrical mounting post 38 of the one of the second mating members 36 is then inserted into the aperture 24 in the first mating member 20 at one end of the segment of elastomeric tubing 46.

The thin cylindrical mounting post 38 of the other of the second mating members 36 is inserted from the bottom of a second flap 52 through the opposing eyelet in the second flap 52 of the shoe 48. The thin cylindrical mounting post 38 of the other of the second mating members 36 is then inserted into the aperture 24 in the first mating member 20 at the other end of the segment of elastomeric tubing 46.

Additional assemblies of two first mating members 20 having a segment of elastomeric tubing 46 therebetween and two additional second members 36 may be installed for each additional opposing pair of eyelets in the shoe 48. By making the segments of tubing 46 of an appropriate length, the effect of the fasteners of the present invention will be to allow the shoe 48 to be installed onto the foot of the wearer (not shown) without removing the fasteners of the present invention. Once the shoe 48 is so installed, the fasteners of the present invention will act to retain the shoe 48 on the foot of the wearer.

By varying the length, thickness, and material of the segments of elastomeric tubing 46, the overall fit and feel of the fasteners of the present invention may be adjusted. As stated above, the preferred material of the segments of elastomeric tubing is silicone rubber or the like, which may be manufactured in any desired color. It will be also appreciated by those skilled in the art that the first and second mating members may be molded of plastic in any color desired.

It may therefore be appreciated from the above detailed description of the preferred embodiment of the present invention that it teaches an improved means of attaching an elastomeric member to eyelets. The attachment means is simple and inexpensive of construction. It is easily attached to eyelets, and requires no tools to make the attachment. Once attached, the fasteners of the present invention remain securely attached to the eyelets to which they are fastened. They are also removable from the shoes onto which they have been installed, in a manner which does not damage the fasteners and which thus allows for their reuse.

In addition, the fasteners of the present invention are quite comfortable in their use on shoes. They allow for the shoes to be put on quite easily, and they retains the flaps of the shoes snugly once they are installed. The fasteners are also highly durable, and will last for an extended period of time. They are aesthetically pleasing as well, and may be made in any of a number of appealing colors. The fasteners of the present invention are also of inexpensive construction, thus further enhancing their marketability. Finally, all of the aforesaid advantages and objectives are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A fastener apparatus for use with shoes of the type having opposed pairs of eyelets therein, said fastener apparatus comprising:

a first mating member comprising a segment having an aperture extending therethrough and a shaft extending outwardly from the side of said segment;

a second mating member having a thin mounting post extending essentially orthogonally from a thin base member, said thin mounting post for extending through one of the eyelets in a shoe;

means for removably securing said thin mounting post of said second mating member in said aperture in said segment of said first mating member; and a segment of elastomeric tubing having a first end and a second end, said first end of said segment of elastomeric tubing being attached to said shaft of a first one of said first mating members, said second end of said segment of elastomeric tubing being attached to said shaft of a second one of said first mating members.

2. A fastener apparatus as defined in claim 1, wherein said segment of said first mating member is essentially cylindrical in configuration, said aperture extending longitudinally through said segment of said first member, said shaft extending radially outwardly from said segment of said first mating member.

3. A fastener apparatus as defined in claim 2, wherein said shaft has a rounded end facilitating introduction of said shaft into said first or second end of said segment of elastomeric tubing.

4. A fastener apparatus as defined in claim 2, wherein said tubing has an inner diameter smaller than an outer diameter of said shaft, thereby making the fit of said first and second ends of said segment of elastomeric tubing on said cylindrical shafts of said first mating members require at least some degree of stretching of said elastomeric tubing.

5. A fastener apparatus as defined in claim 1, wherein said first and second mating members are made of molded plastic.

6. A fastener apparatus as defined in claim 1, wherein said segment of elastomeric material is made of silicone rubber.

7. A fastener apparatus as defined in claim 1, wherein said segment of elastomeric material is adhesively secured to said shafts of said first mating members.

8. A fastener apparatus as defined in claim 1, wherein said thin base member of said second mating member is disc-shaped.

9. A fastener apparatus as defined in claim 1, wherein said means for securing said thin mounting post of said second mating member in said aperture in said first mating member comprises:

first engaging means located in said aperture in said first mating member; and second engaging means located on said thin mounting post of said second mating member, whereby the said first engaging means and said second engaging means are arranged and configured in a manner tending to retain said thin mounting post of said second mating member in said aperture in said segment of said first mating member once said thin mounting post of said second mating member is inserted into said aperture in said segment of said first mating member.

10. A fastener apparatus as defined in claim 9, wherein said first and second engaging means are arranged and configured to allow said thin mounting post of said second mating member to be removed from said aperture in said segment of said first mating member after said thin mounting post of said second mating member has been initially inserted into said aperture in said segment of said first mating member by the application of sufficient force.

11. A fastener apparatus as defined in claim 9, wherein said first engaging means comprises:

a first cylindrical aperture having a first diameter; and a second cylindrical aperture having a second diameter, said second diameter being less than said first diameter, said first and second cylindrical apertures each comprising a segment of said aperture in said segment of said first mating member.

12. A fastener apparatus as defined in claim 11, wherein said thin mounting post has a first outer diameter thereon, said second engaging means comprising:

a first reduced diameter segment spaced away from the end of said thin mounting post opposite said thin base member.

13. A fastener apparatus as defined in claim 12, wherein said first outer diameter of said thin mounting post is smaller than said first diameter of said first cylindrical aperture in said segment of said first mating member but larger than said second diameter of said second cylindrical aperture in said segment of said first mating member, and the diameter of said first reduced diameter segment of said thin mounting post is less than said second diameter of said second cylindrical aperture in said segment of said first mating.

14. A fastener apparatus as defined in claim 13, wherein said first reduced diameter segment of said thin mounting post has a longer length along said thin mounting post than the longitudinal length of said second diameter of said second cylindrical aperture in said segment of said first mating member.

15. A fastener apparatus as defined in claim 13, wherein said second engaging means additionally comprises:

a second reduced diameter segment spaced away from said first reduced diameter segment in a direction toward said thin base member, said second reduced diameter segment also being spaced away from said thin base member.

16. A fastener apparatus as defined in claim 15, wherein the diameter of said second reduced diameter segment of said thin mounting post is substantially the same as the diameter of said first reduced diameter segment of said thin mounting post.

17. A fastener apparatus as defined in claim 16, wherein said second reduced diameter segment of said thin mounting post has a longer length along said thin mounting post than the longitudinal length of said second diameter of said second cylindrical aperture in said segment of said first mating member.

18. A fastener apparatus as defined in claim 15, wherein said first engaging means additionally comprises:

a third cylindrical aperture having a third diameter, said third cylindrical aperture having substantially the same diameter as said first cylindrical aperture, said second cylindrical aperture being located intermediate said first and third cylindrical apertures.

19. A fastener apparatus for use with shoes of the type having opposed pairs of eyelets therein, said fastener apparatus comprising:

a first mating member comprising a cylindrical segment having an aperture extending longitudinally therethrough and a cylindrical shaft extending radially outwardly from the side of said segment;

a second mating member having a thin mounting post extending essentially orthogonally from a thin base member, said thin mounting post for extending through one of the eyelets in a shoe;

means for removably securing said thin mounting post of said second mating member in said aperture in said cylindrical segment of said first mating member;

a third mating member comprising a cylindrical segment having an aperture extending longitudinally therethrough and a cylindrical shaft extending radially outwardly from the side of said segment;

a fourth mating member having a thin mounting post extending essentially orthogonally from a thin base member, said thin mounting post for extending through another one of the eyelets in a shoe;

means for removably securing said thin mounting post of said fourth mating member in said aperture in said cylindrical segment of said third mating member; and a segment of elastomeric tubing having a first end and a second end, said first end of said segment of elastomeric tubing being attached to said cylindrical shaft of said first mating member, said second end of said segment of elastomeric tubing being attached to said cylindrical shaft of said third mating member.

20. A fastener apparatus for use with shoes of the type having opposed pairs of eyelets therein, said fastener apparatus comprising:

a first mating member comprising a segment having an aperture extending therethrough and an attachment member located on said segment;

a second mating member having a mounting post extending from a thin base member for extending through one of the eyelets in a shoe;

means for removably securing said mounting post of said second mating member in said aperture in said segment of said first mating member; and an elongated tubular elastomeric member having a first end and a second end, said first end of said elastomeric member being attached to said attachment member of a first one of said first mating members, said second end of said elastomeric member being attached to said attachment member of a second one of said first mating members.

21. A method of making a fastener apparatus for use with shoes of the type having opposed pairs of eyelets therein, said method comprising:

providing a pair of first mating members each comprising a segment having an aperture extending therethrough and a shaft extending outwardly from the side of said segment;

attaching a first end of a segment of elastomeric tubing to said shaft of a first one of said first mating members;

attaching a second end of said segment of elastomeric tubing to said shaft of a second one of said first mating members; and providing a pair of second mating members each having a thin mounting post extending essentially orthogonally from a thin base member, said thin mounting posts being insertable into said apertures in said segments of said first mating members, said thin mounting posts of said second mating members being removably securable in said apertures in said segments of said first mating members.

22. A closure fastening device for securing opposed eyelets in a shoe, comprising:

a) a pair of first mating members having segments with apertures therein and shafts extending therefrom;

b) a pair of second mating members having base members and longitudinally extending posts secured to said base members;

c) means for removably securing said posts to said first mating members when said posts are disposed within said apertures in said first mating members, and d) elongated elastomeric material having a first end secured to one of said shafts and having an opposite end secured to another of said shafts.

23. The closure fastening device of claim 22 wherein said segment of said first mating member is essentially cylindrical in configuration, said aperture extending longitudinally through said segment of said first member, said shaft extending radially outwardly from said segment of said first mating member.

24. The closure fastening device of claim 22 wherein said first and second mating members are made of molded plastic.

25. The closure fastening device of claim 22 wherein said segment of elastomeric material is made of silicone rubber.

26. The closure fastening device of claim 22, wherein said segment of elastomeric material is adhesively secured to said shafts of said first mating members.

27. The closure fastening device of claim 22, wherein said base member of said second mating member is disc-shaped.

28. The closure fastening device of claim 22, wherein said means for securing said post of said second mating member in said aperture in said first mating member comprises:

first engaging means located in said aperture in said first mating member; and second engaging means located on said post of said second mating member, whereby the said first engaging means and said second engaging means are arranged and configured in a manner tending to retain said post of said second mating member in said aperture in said segment of said first mating member once said thin mounting post of said second mating member is inserted into said aperture in said segment of said first mating member.

29. The closure fastening device of claim 28, wherein said first and second engaging means are arranged and configured to allow said post of said second mating member to be removed from said aperture in said segment of said first mating member after said post of said second mating member has been initially inserted into said aperture in said segment of said first mating member by the application of sufficient force.

30. The closure fastening device of claim 29, wherein said first engaging means comprises:

a first cylindrical aperture having a first diameter; and a second cylindrical aperture having a second diameter, said second diameter being less than said first diameter, said first and second cylindrical apertures each comprising a segment of said aperture in said segment of said first mating member.

31. The closure fastening device of claim 30, wherein said post has a first outer diameter thereon, said second engaging means comprising:

a first reduced diameter segment spaced away from the end of said post opposite said base member.

32. A method of making a fastener apparatus for use with shoes of the type having opposed pairs of eyelets therein, said method comprising:

providing a pair of first mating members each comprising a segment having an aperture extending therethrough and a shaft extending outwardly from the side of said segment;

attaching a first end of a segment of elastomeric material to said shaft of a first one of said first mating members;

attaching a second end of said segment of elastomeric material to said shaft of a second one of said first mating members; and providing a pair of second mating members each having a thin mounting post extending essentially orthogonally from a thin base member, said thin mounting posts being insertable into said apertures in said segments of said first mating members, said thin mounting posts of said second mating members being removably securable in said apertures in said segments of said first mating members.

* * * * *